United States Patent [19]

Selke et al.

[11] 3,951,252

[45] Apr. 20, 1976

[54] ELECTROMECHANICAL WRITING DEVICE

[75] Inventors: Reimund Selke, Detmold; Udo Obersteller, Neuss; Kurt Richter, Rinteln, all of Germany

[73] Assignee: Nixdorf Computer AG, Germany

[22] Filed: Aug. 28, 1974

[21] Appl. No.: 501,282

[30] Foreign Application Priority Data

Aug. 30, 1973 Germany ..... 2343858

[52] U.S. Cl. ..... 197/133 A; 197/1 R; 83/482

[51] Int. Cl.[2] ..... B41J 15/00

[58] Field of Search ..... 197/1 R, 133 A, 180, 197/181.2, 127 R, 133 R; 101/224, 226, 227; 83/485, 487, 482, 614, 12

[56] References Cited

UNITED STATES PATENTS

| | | | |
|---|---|---|---|
| 1,362,544 | 12/1920 | Smith | 197/133 A |
| 1,615,598 | 1/1927 | Smith | 197/133 A |
| 2,360,196 | 10/1944 | Brumhill | 197/133 A |
| 2,427,611 | 9/1947 | Lane | 197/133 A X |
| 3,080,784 | 3/1963 | Schneider | 83/482 |
| 3,686,991 | 8/1972 | Fujimoto | 83/487 X |
| 3,707,214 | 12/1972 | Ponzano | 197/133 A X |

OTHER PUBLICATIONS

Welch et al., "Paper Cutting Attachment For Printer," IBM Tech. Discl. Bull., Vol. 14, No. 12, May 1972.

*Primary Examiner*—Edgar S. Burr
*Assistant Examiner*—R. T. Rader
*Attorney, Agent, or Firm*—Gifford, Chandler & Sheridan

[57] ABSTRACT

An electromechanical writing device comprising a writing head, a writing head carrier for carrying the writing head, a guide along which the writing head carrier is movable during a writing operation, a writing platen over which, in operation, a recording medium, e.g. paper, is moved during the writing operation, a shearing edge forming part of the writing platen and extending in a direction parallel to the direction of movement of the writing head, and a roller knife mounted for movement along the guide and cooperating with the shearing edge to permit the recording medium to be cut.

7 Claims, 7 Drawing Figures

ELECTROMECHANICAL WRITING DEVICE

BACKGROUND OF THE INVENTION

I. Field of the Invention

This invention relates generally to electromechanical writing devices and more particularly to a means for cutting the writing medium.

II. Prior Art

Electromechanical writing devices are suitable for writing on a recording medium which is guided through the writing device in a stepwise manner from a stopper recording medium. It is necessary that the recording medium can be cut off at any required point, for example to permit either the separation of individual portions of writing or a fresh start to a piece of writing in the event of a defect in the writing operation.

Tearing the recording medium as it emerges from the writing device not only entails a special manual operation but also may damage the recording medium such as by a lengthwise tear.

SUMMARY OF THE INVENTION

According to the present invention there is provided an electromechanical writing device comprising a writing head, carrier means for carrying the writing head, guide means along which the carrier means is movable during a writing operation, a writing platen over which a recording medium is moved during the writing operation, a shearing edge forming part of the writing platen, the shearing edge extending in a direction parallel to the direction of movement of the writing head, a roller knife mounted for guided movement along the guide means and cooperating with the shearing edge to permit the recording medium to be cut.

The writing device may include coupling means for coupling a roller knife carrier to said carrier means. In this way it is possible to feed electric control signals for operating the roller knife directly to the electromechanical coupling means. Since the carrier means is, in any event, moved along the guide means, if it is desired to operate the roller knife, the electromechanical coupling means can be actuated and thus the carrier means, together with the roller knife carrier, can be moved along the guide means as a single unit. Since the roller knife cooperates with the shearing edge, the separation of the recording medium then takes place automatically and simultaneously with the movement of the carrier means.

The writing device may include retaining means for retaining the roller knife carrier in a rest position at one end of the writing platen. The retaining means may comprise a permanent magnet which cooperates with a frame part to retain the roller knife carrier in the rest position. Thus the roller knife carrier is automatically detained in the rest position as the permanent magnet approaches the frame part in the case where the electromechanical coupling means is not actuated.

The writing device may include resilient means for resiliently biasing the roller knife into contact with the shearing edge, the roller knife having roller means which cooperates with a guide surface disposed adjacent the rest position of the roller knife carrier, the guide surface being inclined to the direction of movement to the roller knife, the arrangement being such that cooperation between the roller means and the guide surface moves the roller knife away from the shearing edge against the action of the resilient means.

Means may be provided on the roller knife carrier for releasing a locking mechanism for retaining two parts of a frame of the writing device together.

The writing device may include a movable lever on said frame part which is biased towards the permanent magnet when the latter is in the rest position defined by said lever.

BRIEF DESCRIPTION OF THE DRAWINGS

The invention is illustrated, merely by way of example, in the accompanying drawings, in which.

DETAILED DESCRIPTION

Figure 1:
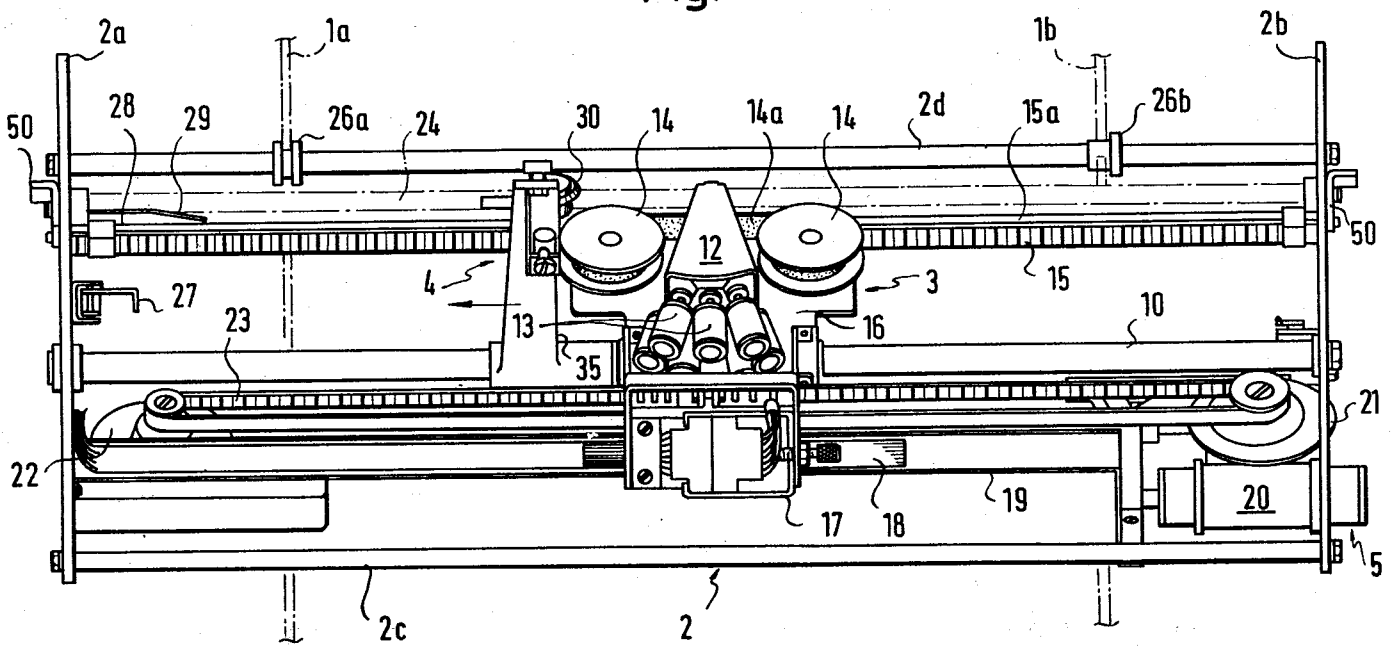
FIG. 1 is a plan view of an electromechanical writing device according to the process of the invention.

The terms 37 left", "right", "front", "rear", etc., used in the following description refer to the directions as seen in the drawings.

Referring to the drawings there is shown one embodiment of an electromechanical writing device according to the present invention. The writing device comprises a writing head 12 which is in the form of a mosaic printer. The writing head 12 forms part of a writing mechanism 3 which includes the carrier 16 and spools 14 carrying an inked ribbon 14*a* therebetween. The writng mechanism 3 can be moved to the left and right along a guide bar 10 disposed parallel to the direction of lines of writing produced by a writing operation. A drive 5 is provided for moving the writing mechanism along the guide bar 10, the drive consisting of an electric motor 20, a drive disc 21, a toothed belt 23 and a guide pulley 22. The writing head 12 is controlled by electric signals fed thereto via a multiple core cable 18 which is laid in a duct 19 and which, while the writing mechanism 3 is in motion, is carried along by the corresponding formation of loops in the duct 19. A second toothed belt 15 which rests against a cross bar 15a and which cooperates with gear wheels of the writing mechanism 3, causes the inked ribbon 14*a* to be moved between the spools 14.

These parts of the electromechanical writing device are disposed within an upper part 2 of a frame which consists, inter alia, of a pair of side plates 2*a*, 2*b*. A rear connecting bar 2*c* and a front connecting bar 2*d* interconnect the side plates. The connecting bar 2*d* defines a pivot axis and is mounted on a lower part 1 of the frame of which only two plates 1*a*, 1*b* are shown (in phantom line in FIG. 1). The connecting bar 2*d* is mounted on the plates 1*a*, 1*b* via respective sleeve elements 26*a*, 26*b*. The upper part 2 of the frame is thus capable of pivoting about the connecting bar 2*d* relative to the lower part 1 of the frame. The upper part 2 of the frame may be locked relative to the lower part 1 of the frame by means of locking levers 50 on the outer sides of the side plates 2*a*, 2*b*. Associated with one of the locking levers 50 is an unlocking device which can be actuated in a predetermined position of a cutting device 4 as will be described hereinafter.

The cutting device 4 is mounted for movement along the guide bar 10 adjacent to the writing mechanism 3 and comprises a roller knife 30 and a roller knife carrier 35. The roller knife 30 is capable of traversing a writing platen 24 which forms part of the lower part 1 of the frame and which is shown in dot-dash lines in FIG. 1. Associated with the roller knife 30 is a guide 28 having an inclined surface 29 cooperating with the roller knife 30 when the latter is in a first position at the left-hand side of the writing platen.

Figure 2:
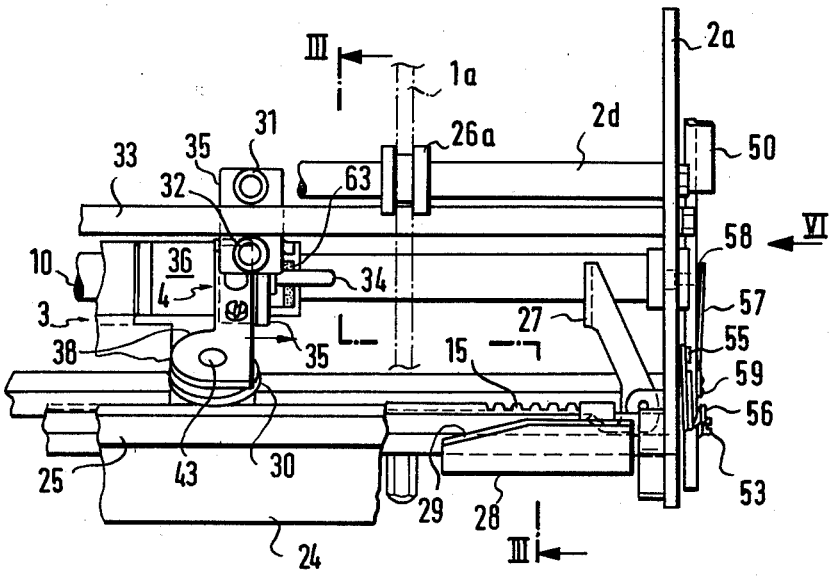
FIG. 2 is a front view of part of the writing device of FIG. 1.

The association between the cutting device 4 and the writing platen 24 is shown most clearly in FIG. 2. The writing platen forms a surface over which a recording medium (not shown), such as paper, is guided while the writing operation is performed upon it by the writing head 12. The writing platen 24 is straight and extends the whole length of the writing device and is provided with a straight cutting edge 25. This cutting edge is ground on the side which cooperates with the roller knife 30 in such a way as to form a shearing edge past which the cutting edge of the roller knife 30 moves when the cutting device 4 is moved in the direction of the arrow shown in FIG. 2 or in the opposite direction. In FIG. 2 only part of the writing platen 24 and the cutting edge 25 is shown so that other mechanisms associated with the cutting device 4 can be illustrated. Since the cutting device 4 is slidably mounted on the guide bar 10, it is guided on the latter by means of a guide bushing 36. Also mounted on the roller knife carrier 35, which is connected to the guide bushing 36, is a permanent magnet 63 which, in the right hand end position of the cutting device 4, can adhere to a lever 27 which is part of the side plate 2*a* and defines the rest position of the roller knife. A guide bar 33 having a square cross section on which the roller knife carrier 35 is guided by two roller bearings 31, 32 absorbs the cutting pressure resulting during a cutting operation. Thus during a cutting operation the roller knife 30 is braced on the guide bar 33.

A pin 34 is disposed on the roller knife carrier 35 to act on an unlocking mechanism, provided on the side plate 2*a* when the cutting device 4 is carried beyond its rest position determined by the lever 27 and into a right hand end position. In this arrangement a part 41 of the roller knife 30 is guided over the inclined surface 29 of the guide 28 in such a way that the roller knife is pivoted on its spindle 43 and its cutting edge is disengaged from the cutting edge 25. Depending on the position of the guide 28, this may also be the case in the normal rest position of the cutting device 4.

Figure 3:
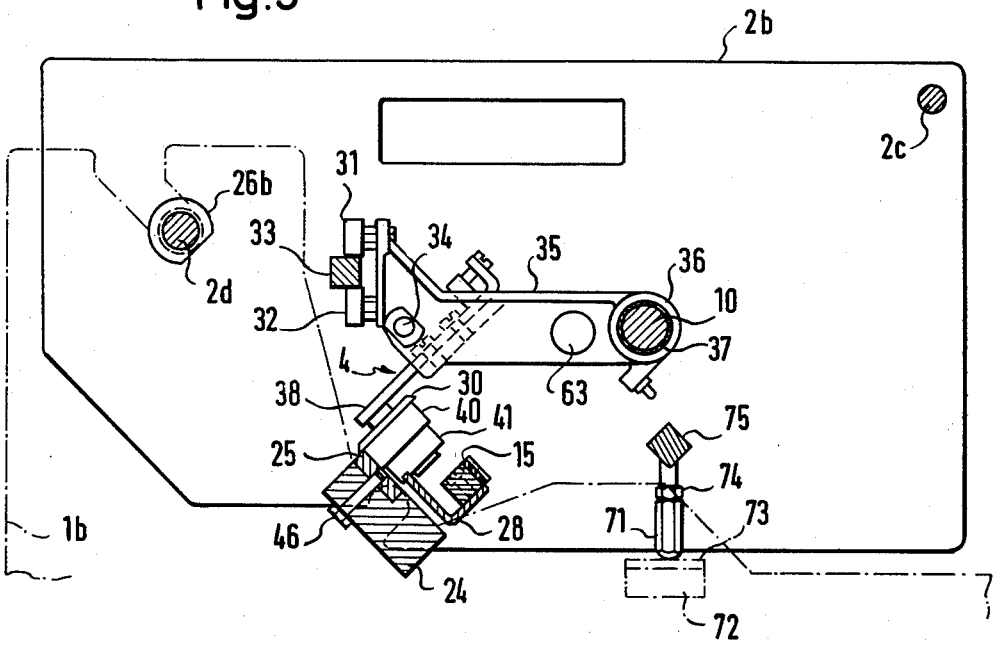
FIG. 3 is a section of the writing device of FIG. 2 taken along the line III—III.

Referring to FIG. 3 there is shown the relationship between the roller knife 30, the writing platen 24 and the cutting edge 25. The cutting edge 25 is fixed to the writing platen 24 by screws 46. For adjusting the range of pivotal movement of the upper part 2 of the frame relative to the lower part 1 of the frame, there are provided set screws 71 which can be adjusted relative to a stock face 73 on a retaining angle piece 72 and a lower part 1 of the frame and fixed by a lock nut 74 relative to a cross bar 75 on the upper part 2 of the frame. Through this simple construction which makes it possible to limit the range of pivotal movement of the upper part 2 of the frame about the connected bar 2*d*, it is possible to adjust, in a very precise and simple manner, the distance between the writing head 12 and the writing platen 24.

By virtue of the fact that the writing platen 24 forms a writing plane which bisects, in its longitudinal direction, an imaginary cylinder placed around the connecting bar 2*d*, it is possible to pivot the whole of the upper part 2 of the frame away from the lower part 1 of the frame so that there is no risk of any damage to the sensitive writing head. In this connection, and in particular when pivoting the upper part 2 of the frame towards the lower part 1 of the frame, the pivoting of the roller knife 30 about the spindle 43, which is achieved by the guide 28, proves particularly advantageous since this also prevents damage to the shearing edges of the roller knife 30 and the cutting edge 25.

FIG. 3 further illustrates the way in which the roller knife carrier 35 is mounted on the guide bar 10 and on the guide bar 33. The guide bushing 36, which for better guiding, is provided with an inner sleeve 37, preferably made of plastic, and which runs on the guide bar 10. The permanent magnet 63 is disposed on the roller knife carrier 35 adjacent the guide bushing 36. The two roller bearings 31, 32 are associated with the roller knife 30 in such a way that the component of cutting pressure which absorb most satisfactory is that occurring in the direction of movement of the roller knife 35 about the guide bar 10.

Figure 4:
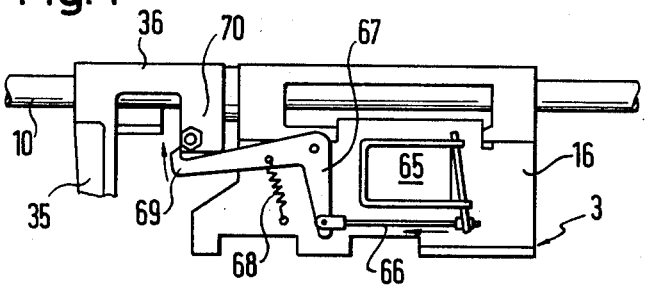
FIG. 4 shows a coupling mechanism between a writing head carrier and a roller knife carrier of the writing device of FIG. 1.

FIG. 4 shows the coupling mechanism between the roller knife 35 and the writing mechanism 3. On the carrier 16 of the writing mechanism is an electromagnet 65 which can be triggered by electrical signals supplied thereto by way of a connecting line (not shown). The armature of the electromagnet 65 is coupled via a connecting rod 66 with a bell crank lever 67 which is held by a spring 68 in a rest position in which it is uncoupled from the roller knife carrier 35. If the electromagnet 65 is energized, a hooked end 69 on the bell crank lever 67 engages a projection 70 on the roller knife carrier 35, thus producing a rigid mechanical coupling between the roller knife carrier 35 and the carrier 16 and the entire cutting device 4 is transported to the right along the guide bar 10, together with the writing mechanism 3. During this movement, the roller knife 30 can perform a cutting operation in conjunction with the cutting edge 25.

Figure 5:
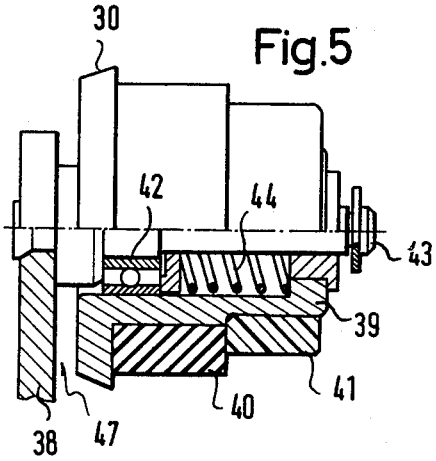
FIG. 5 shows details of the construction of a roller knife of the writing device of FIG. 1.

FIG. 5 shows in greater detail the construction of the roller knife 30. The roller knife 30 is rotatably mounted via a ball bearing assembly 42 on a spindle 43. The spindle 43 is fixed to an arm 38 to the roller knife carrier 35. The roller knife 30 has a body 39 with rubber rollers 40, 41 disposed thereon, so that it can slide as a unit on the spindle 43. In the body 39 is a helical spring 44 by which the shearing edge of the roller knife 30 is pressed to the right (FIG. 5) against the cutting edge 25. This compensates for areas of parallelism between the writing platen 24 and the guide bar 10. Moreover, there is, as a result, the advantage of simplicity of adjustment and the possibility of separating the cutting edge 25 and the roller knife 30 at will. This separation can be carried out in the described way by moving the roller knife 30 on the guide 28. The roller knife is then shifted over a space 47 against the action of the helical spring 44 towards the arm 38.

Figure 6:
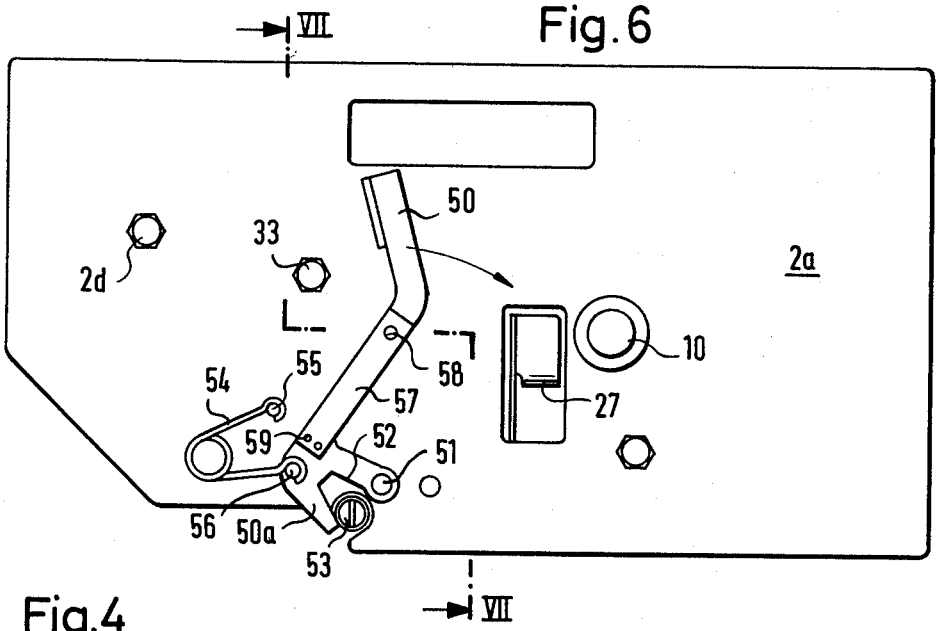
FIG. 6 is a side elevational view of the writing device looking in the direction of an arrow VI of FIG. 2.
Figure 7:
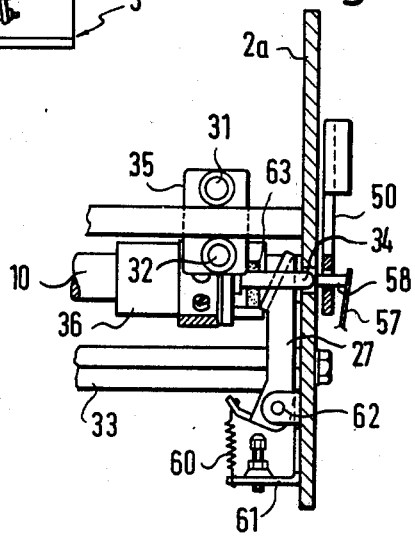
FIG. 7 is a section of the writing device taken along the line VII—VII in FIG. 6.

FIGS. 6 and 7 show an unlocking device which may be associated with one or more of the side plates 2*a*, 2*b*. This unlocking device is actuated by the cutting device 4 and thus permits the upper part 2 of the frame to be pivoted away from the lower part 1 of the frame. FIG.

6 shows the side plate 2*a* with its outer side and it can be seen that the unlocking lever 50 can be swung around a fulcrum 51 so that its lower jaw 50*a* is removed from a locating pin 53 which serves to adjust and support the writing platen 24. The locking lever 50 is retained in its illustrated rest position in which the upper part 2 of the frame cannot pivot around the connecting bar 2*d*, by means of a spring 54. The spring 54 is fixed by a pin 55 to the side plate 2*a*, at one end and by a pin 56 to the unlocking lever 50, at its other end. The unlocking lever 50 is provided with a leaf spring 57 which is riveted to it at a point 59 and is provided with a pin 58 which is led to the unlocking lever 50 and disposed in a bore (not shown) in the side plate 2*a*. Only when this pin 58 is pushed out of the bore in the side plate 2*a* can the unlocking lever be pivoted in the direction of the arrow shown in FIG. 6 and removed from the locking pin 53.

FIG. 7 shows how the pin 58 on the leaf spring 57 can be taken out of the respective bore in the side plate 2*a*. The pin 34, which is fixed to the roller knife carrier 35, is used for this purpose. When the cutting device 4 is moved out of its rest position, determined by the cooperation of the lever 27 and the permanent magnet 63, into the right hand end position, and beyond, the pin 34 pushes the pin 58 out of the bore of the side plate 2*a* in opposition to the force of the leaf spring 57 and the unlocking lever 50 can be swung in the manner already described.

The lever 27 determining the rest position of the cutting device 4 is mounted at a point 62 on the side plate 2*a* and is retained in the illustrated position by a spring 60. The spring 60 is likewise fastened to the side plate 2*a* by way of a supporting angle piece 61. The lever 27 under spring tension gives the additional advantage that in a rapid transport movement, the cutting device 4 can overshoot its fixed rest position, after which it is returned to the position of rest by the spring force of the spring 60. This process is reinforced by the attractive power of the permanent magnet 63.

An unlocking arrangement of the above described type can also be provided on the side plate 2*b*. In this case the carrier 16 for the writing head 12 must be provided with a part corresponding to the unlocking pin 34 and facing the side plate 2*b*.

The writing device described above makes it possible to utilize the writing platen simultaneously as a cutting element. The roller knife is guided past the shearing edge and, since the writing platen is disposed parallel to the direction of the lines of writing produced by the writing operation, it automatically cuts the recording medium in the direction of those lines. Since the roller knife is disposed on the guide bar 10, the latter guides not only the writing head but also the cutting device with the result of a reduction in a number of parts in the writing device. Since the guide bar has to be mounted with maximum precision relative to the writing platen for the purpose of producing clear writing, this precision is utilized for the cutting operation as well. The movement of the roller knife on the guide bar may, like the movement of the carrier 16, be effected by an electric driving device which can be triggered with electric control signals.

We claim:

1. An electromechanical writing device comprising:

a writing head;

carrier means for carrying the writing head;

guide means along which the carrier means is movable during a writing operation;

a writing platen over which during a writing operation a recording medium is moved;

a shearing edge forming part of the platen and extending in a direction parallel to the direction of movement of the writing head, said shearing edge being disposed beneath the writing area of said writing head;

a knife carrier slidably mounted on said guide means and having generally cylindrical roller knife rotatably mounted on said knife carrier and adapted to cooperate with said shearing edge to cut the recording medium; and coupling means to selectively lock said knife carrier to said carrier means so that upon actuation said knife carrier slides along said guide means in unison with said carrier means to cut the recording medium.

2. The invention as defined in claim 1 wherein said coupling means are electromechanical coupling means.

3. The invention as defined in claim 2 and including retaining means for retaining the knife carrier in a rest position at one end of the writing platen.

4. The invention as defined in claim 3 in which the retaining means includes a permanent magnet which cooperates with a frame member to retain the knife carrier in the rest position.

5. The invention as defined in claim 3 including resilient means for resiliently biasing the roller knife into contact with the shearing edge, the roller knife having roller means which cooperate with a guide surface disposed adjacent the rest position of the roller knife carrier, the guide surface being inclined to the direction of movement of the roller knife, the arrangement being that cooperation between the roller means and the guide surface moves the roller knife away from the shearing edge against the action of the resilient means.

6. The invention as defined in claim 2 and including means provided on the knife carrier for releasing a locking mechanism for retaining two parts of a frame of the writing device together.

7. The invention as defined in claim 4 including a movable lever on said frame member which is biased towards the permanent magnet when the latter is in the rest position defined by said lever.

* * * * *